US005531261A

United States Patent [19]

Yoshida et al.

[11] Patent Number: 5,531,261

[45] Date of Patent: Jul. 2, 1996

[54] PROCESS FOR DIECASTING GRAPHITE CAST IRON AT SOLID-LIQUID COEXISTING STATE

[75] Inventors: Chisato Yoshida; Yuichi Ando; Kunio Kitamura; Seiro Yahata, all of Chiba, Japan

[73] Assignee: Rheo-Technology, Ltd., Japan

[21] Appl. No.: 366,672

[22] Filed: Dec. 30, 1994

[30] Foreign Application Priority Data

Jan. 13, 1994 [JP] Japan ..... 6-014082
Sep. 26, 1994 [JP] Japan ..... 6-229598

[51] Int. Cl.[6] ..... B22D 27/09; B22D 23/06; B22C 9/00

[52] U.S. Cl. ..... 164/113; 164/900; 164/80

[58] Field of Search ..... 164/113, 900, 164/80

[56] References Cited

U.S. PATENT DOCUMENTS 4,345,637 8/1982 Flemings et al. ..... 164/113
4,986,338 1/1991 Yamauchi et al. ..... 164/113

FOREIGN PATENT DOCUMENTS 0254437 1/1988 European Pat. Off. .
0513523A1 11/1992 European Pat. Off. .
2665654 2/1992 France .
4-52059 2/1992 Japan ..... 164/80
5043978 2/1993 Japan .
5044010 2/1993 Japan .
6106321 4/1994 Japan .

OTHER PUBLICATIONS

Bex, Tom, "Thixomolding Promises Savings," *Modern Casting*, No. 8, Aug. 1992, p. 24.
"Manufacture of Automotive Components by Pressure Diecasting in Semi Liquid State," *Foundry Trade Journal Sup. Diecasting World*, Oct. 1992, pp. 74–76.

*Primary Examiner*—Jack W. Lavinder
*Assistant Examiner*—I.-H. Lin
*Attorney, Agent, or Firm*—Austin R. Miller

[57] ABSTRACT

Graphite cast iron is diecast at a solid-liquid coexisting state with a mold having a gate opened at an area of not more than 1/10 of a pressurized area of a plunger tip.

4 Claims, 3 Drawing Sheets

PROCESS FOR DIECASTING GRAPHITE CAST IRON AT SOLID-LIQUID COEXISTING STATE

BACKGROUND OF THE INVENTION

1. Field of the Invention

This invention relates to a process for diecasting graphite cast iron at a solid-liquid coexisting state.

2. Description of the Related Art

In general, cast iron is widely used in various fields such as automobile parts and the like because it is good in castability and can be cast into products of complicated shapes. To this end, if thin-walled products can be produced by industrially diecasting the cast iron, the weight reduction of the product can significantly be attained. However, the melting point of the cast iron is very high (not lower than 1150° C.), so that there is no mold material durable to the melting temperature of the cast iron.

As the industrial diecasting process of the cast iron, it is possible only to conduct the diecasting at a temperature of solid-liquid coexisting state which is lower than the melting point of the cast iron and has less latent heat, so that it is strongly desired to industrially develop such a diecasting.

Although diecasting of cast iron is not yet industrialized, there is known a method of injecting a melt of the cast iron from a diecasting machine. When a melt of spheroidal graphite cast iron is diecast in the diecasting machine, there is a problem in the heat resistance of the mold as mentioned above, and also Ca or Mg as a graphite spheroidizing agent is easily evaporated at a molten state of the spheroidal graphite cast iron. In the latter case, even if the melt is formed in the vicinity of the diecasting machine as much as possible, counter measures should be taken to prevent the evaporation of the graphite spheroidizing agent or further adding the graphite spheroidizing agent to the melt.

In cases of conducting the diecasting at the solid-liquid coexisting state, there are known rheocasting process and thixocasting process. The rheocasting process is a process in which a slurry of semi-solidified metal composition is directly supplied to a diecasting machine and then injection molded therefrom, while the thixocasting process is a process in which a continuously cast billet or the like is reheated to a temperature of solid-liquid coexisting state and supplied to a diecasting machine and then injection molded therefrom. In the thixocasting process, the billet is reheated to a temperature lower than the melting point in a short time, so that there is caused substantially no evaporations of the graphite spheroidizing agent.

In the rheocasting process, however, the entrapment of air and inclusions is undesirably caused, and there are problems in the matching of throughput capacity between the continuous production device and the working device of the semi-solidified metal composition, the handling of the semi-solidified metal composition slurry, the process control and the like, so that this process is not yet industrialized.

In the thixocasting process, when the ingot of spheroidal graphite cast iron statically solidified is injected at the solid-liquid coexisting state, dendritic crystals entangle with each other to form a large lump. The lump moves through the diecasting machine, so that the crystals remain in the mold as a lump. As a result, only liquid phase metal is fed into the mold. Consequently a cast product having a uniform structure is not obtained.

As a measure for improving uniformization of the product structure, there is a method of using an ingot of cast iron having a granular primary crystal (in case of a hypo-eutectic structure, the primary crystal is ferrite). However, the ingots of granular structure for the diecasting are obtained by the following methods and have the following problems accompanied therewith.

1) A melt of the ingot is solidified with stirring. In this case, there is caused entrapment of air during the stirring, entrapment of broken pieces of the agitator, fluctuation of the composition and the like.
2) A cast ingot statically solidified is subjected to plastic working to impart strain and then granulated by heating. However, it is difficult to adopt this method because the cast iron is poor in plastic workability.
3) A melt of the ingot is added with an inoculating agent and then cast into a given shape. In this case, eutectic cells (crystal grain consisting of iron and graphite) can be made fine, but the effect of fineness of the primary crystal grains is small.

SUMMARY OF THE INVENTION

It is, therefore, an object of the invention to provide a process for diecasting graphite cast iron at a solid-liquid coexisting state to form a diecast product having a uniform structure even when using not only a cast iron ingot of granular structure in the thixocasting process but also a cast iron ingot of dendritie structure statically solidified in the usual manner.

According to the invention, there is the provision of a process for diecasting graphite cast iron at a solid-liquid coexisting state, which comprises heating an ingot of graphite cast iron to a temperature of solid-liquid coexisting state and then injecting through a tip of a plunger into a mold having a gate opened at an area of not more than 1/10 of a pressurized area of the tip.

In a preferable embodiment of the invention, a graphite cast iron of flake hypo-eutectic structure or a spheroidal graphite cast iron is used as the graphite cast iron. In another preferable embodiment, the ingot is heated to a given temperature of solid-liquid coexisting state and held at this temperature for not less than 3 seconds. In another preferable embodiment, the ingot is a structure of spheroidal graphite having a diameter of not more than 100 μm or a ledeburite structure formed by rapid solidification.

BRIEF DESCRIPTION OF THE DRAWINGS

The invention will be described with reference to the accompanying drawings, wherein.

DESCRIPTION OF THE PREFERRED EMBODIMENTS

Figure 1:
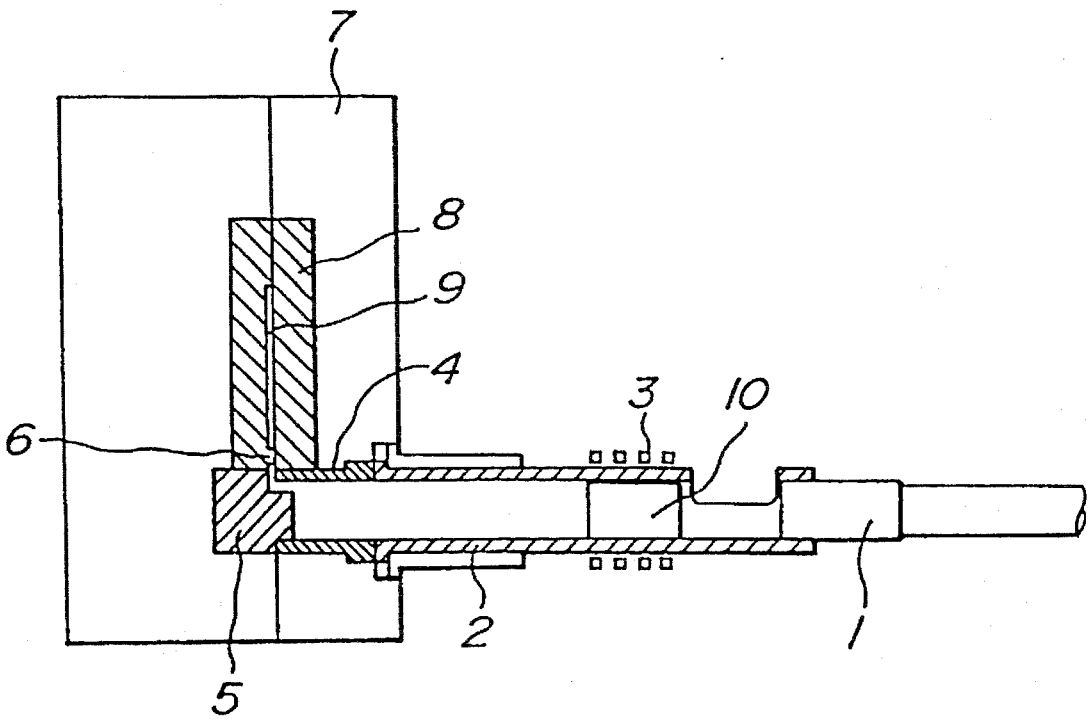
FIG. 1 is a diagrammatic view partly shown in section of a diecasting machine used in the invention.

In the diecasting of the graphite cast iron at the solid-liquid coexisting state according to the invention, the molten ingot of the graphite cast iron is injected into the mold having a gate opened at an area of not more than 1/10 of a pressurized area of the plunger tip.

Thus, when the molten ingot is passed through the narrow gate having an opening area corresponding to not more than 1/10 of the pressurized area of the plunger tip, even if the ingot is a spheroidal graphite cast iron having dendritic primary crystals statically solidified in the usual manner, dendrite crystals are finely broken to equally disperse in the mold, whereby a diecast product having a uniform microstructure is obtained.

Moreover, when the ingot is heated to the temperature of solid-liquid coexisting state, graphite in the ingot may not completely be dissolved to form an undissolved graphite portion. If the molten ingot having the undissolved graphite portion is injected into the mold, the undissolved graphite portion is included into the diecast product as it is, so that it is difficult to obtain the uniform microstructure. Therefore, it is important that the ingot is heated to a given temperature of solid-liquid coexisting state and held at this temperature for not less than 3 seconds to completely dissolve graphite. If the holding time is less than 3 seconds, the iron-graphite eutectic cell in the ingot can not completely be dissolved.

Further, the size of crystal grains in the ingot largely depends on the size of the primary crystals in the diecast product. In order to obtain diecast products having finer primary crystals and uniform quality, therefore, it is important to make the crystal structure of the ingot finer. For this purpose, molten iron is cooled at a rate of not less than 1° C./s in the production step of the cast iron ingot.

When the spheroidal graphite cast iron having a diameter of not more than 100 μm is used as the ingot, the dissolution of graphite is facilitated to provide a more uniform solid-liquid coexisting state by reheating to a given temperature of solid-liquid coexisting state and hence the diecast product having a more uniform microstructure is obtained. If the diameter exceeds 100 μm, the distance between graphite grains is wider and it is difficult to provide the uniform solid-liquid coexisting state when the ingot is reheated to a given temperature of solid-liquid coexisting state.

On the other hand, when the rapid solidification (e.g. not less than 1° C./s) is carried out in the casting, ledeburite structure (eutectic structure of austenite and cementite) is produced in the microstructure of the ingot. When the ledeburite structure is reheated to a given temperature of solid-liquid coexisting state, it is easily dissolved to provide a very uniform solid-liquid coexisting state.

According to the invention, the ingot of the graphite cast iron is diecast at the solid-liquid coexisting state, so that the heat-bearing capacity of the mold is mitigated as compared with the case of diecasting molten iron and hence the service life of the mold can largely be prolonged.

The following examples are given in illustration of the invention and are not intended as limitations thereof.

EXAMPLE 1

A statically solidified ingot of spheroidal graphite cast iron containing C: 3.10 mass %, Si: 2.03 mass %, Mn: 0.82 mass % and Mg: 0.038 mass % was diecast at a solid-liquid coexisting state under the following diecasting conditions and the structure of the resulting diecast product was investigated. For the comparison, there was used an ingot stirred at the solid-liquid coexisting state and solidified under cooling.

Diecasting conditions:

Diameter of tip of plunger: 62 mm

Injection speed: 1 m/s

Injection pressure: 120 MPa

Temperature of ingot: 1160° C. (solid fraction: 0.3) (high frequency induction heating in sleeve)

Opening area of gate: 60 mm×t mm t=2, 5 or 6 mm

Product size: 80 mm×80 mm×10 mm

Figure 2B:
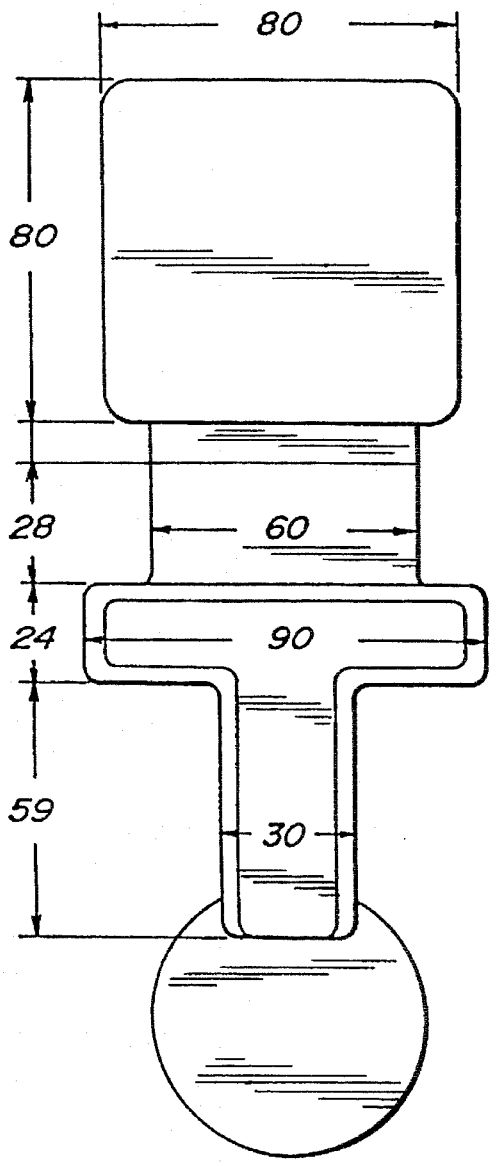
FIG. 2*b* is a diagrammatic side view illustrating a gate of a mold and a shape of a product shown in FIG. 2*a;*
Figure 2A:
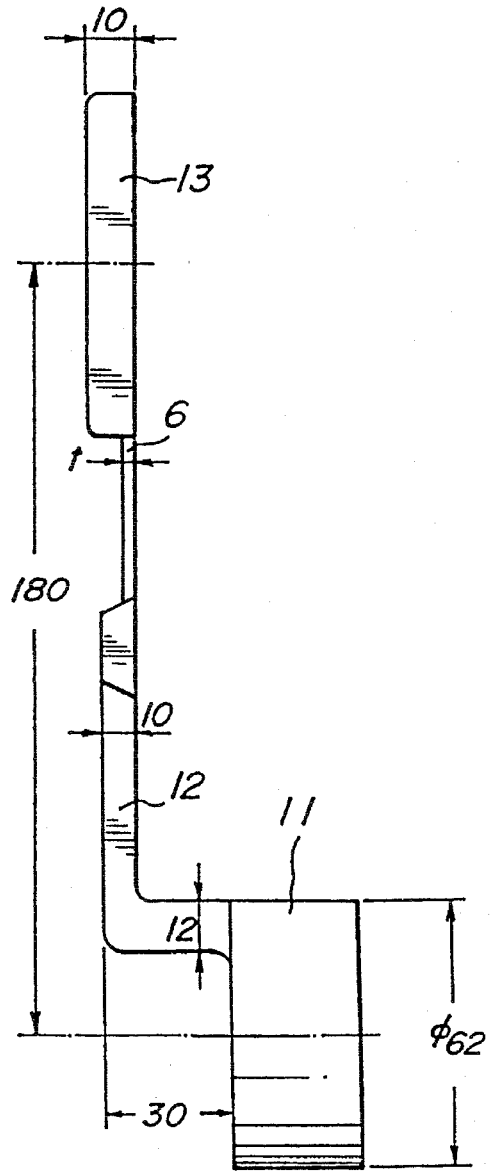
FIG. 2*a* is a diagrammatic front view illustrating a gate of a mold and a shape of a product.

In FIG. 1 is shown a diecasting machine used in this example and shapes of a gate in a mold and a diecast product are shown in FIGS. 2*a* and 2*b*. In these figures, numeral 1 is a tip of a plunger, numeral 2 a sleeve, numeral 3 a high frequency heating coil, numeral 4 a mold sleeve, numeral 5 a spreader, numeral 6 a gate, numeral 7 a mold, numeral 8 cavity block, numeral 9 a cavity, numeral 10 an ingot, numeral 11 a biscuit, numeral 12 a runner and numeral 13 a diecast product.

The results are shown in Table 1.

TABLE 1

| Sample No. | Ingot | Size of gate (mm) | Gate area/ area of plunger tip | Structure of product | Void defect | Remarks |
|---|---|---|---|---|---|---|
| 1 | statically solidified ingot | 60 × 2 | 1/25.2 | uniform | absence | Acceptable example |
| 2 | statically solidified ingot | 60 × 5 | 1/10.1 | uniform | absence | Acceptable example |
| 3 | statically solidified ingot | 60 × 6 | 1/8.4 | ununiform | absence | Comparative example |
| 4 | stirred solidification ingot | 60 × 2 | 1/25.2 | uniform | presence | Comparative example |

As seen from Table 1, in the sample Nos. 1, 2 and 4 in which the opening area of the gate is not more than 1/10 of the pressurized area of the plunger tip, diecast products having a uniform structure are obtained, while diecast product having a uniform structure is not obtained in the sample No. 3 in which the opening area is 1/8.4.

In the sample No. 4, void defects existed in the product. This is due to the fact that the void defects existing in the stirred solidification ingot are retained in the diecast product.

On the other hand, the diecast products have a microstructure that iron as a primary crystal is distributed in the form of grains and a structure between the grains is ledeburite structure (eutectic structure of iron and cementite) due to the rapid cooling in the diecasting.

When the diecast product is subjected to a heat treatment for graphitizing the ledeburite structure of the product, the ledeburite can be graphitized by heating to a temperature of 800°–900° C. in a very short time. In the sample Nos. 1 and 2 according to the invention, therefore, there are obtained products having an excellent quality without void defects in which fine graphite is uniformly dispersed therein.

EXAMPLE 2

A cast iron of hypo-eutectic structure containing C: 3.10 mass %, Si: 2.03 mass % and Mn: 0.82 mass % (liquidus temperature: 1230° C., solidus temperature: 1135° C.) was used as an ingot. In this case, a statically solidified ingot of flake graphite structure having dendritic primary crystal (ferrite) (cooling rate was varied from molten iron) and a stirred solidification ingot of granular structure solidified under cooling while stirring to a solid fraction of 0.2 were used and diecast at solid-liquid coexisting state under the same diecasting conditions as in Example 1 in the same manner as in Example 1 and then the uniformity of the structure and presence or absence of void were investigated with respect to the resulting diecast products.

The results are shown in Table 2.

TABLE 2

| Sample No. | Ingot | Holding time at heating | Size of gate (mm) | Gate area/ area of plunger tip | Structure of product | Void |
|---|---|---|---|---|---|---|
| 1 | statically solidified ingot | 3 | 60 × 2 | 1/25.2 | uniform | absence |
| 2 | statically solidified ingot | 3 | 60 × 5 | 1/10.1 | uniform | absence |
| 3 | statically solidified ingot | 3 | 60 × 6 | 1/8.4 | ununiform | absence |
| 4 | stirred solidification ingot | 3 | 60 × 2 | 1/25.2 | uniform | presence |
| 5 | statically solidified ingot | 3 | 60 × 2 | 1/25.2 | course structure of graphite in the ingot locally remains | absence |

As seen from Table 2, in the sample Nos. 1, 2, 4 and 5, diecast products having a uniform structure were obtained, while diecast product having a uniform structure were not obtained in the sample No. 3 in which the opening area of the gate was more than 1/10 of the pressurized area of the plunger tip.

In the sample No. 4, void defect is existent in the product. This is due to the fact that the void defect existing in the stirred solidification ingot was retained in the diecast product. In the sample No. 5, the structure of the product locally becomes coarse when the diecasting was conducted immediately after the heating of the ingot. In view of the product quality, it was favorable that the statically solidified ingot is used as the starting ingot and the cooling rate in the casting step was not less than 1° C./s and the holding time after the ingot was reheated to the given temperature was not less than 3 seconds.

Figure 3A:
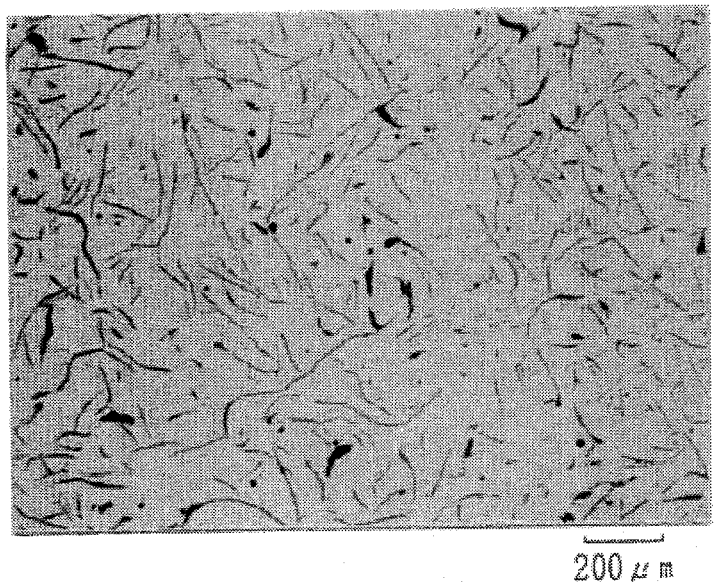
FIG. 3*a* is a photomicrograph showing a metallic structure of an ingot of a flake graphite cast iron.
Figure 3B:
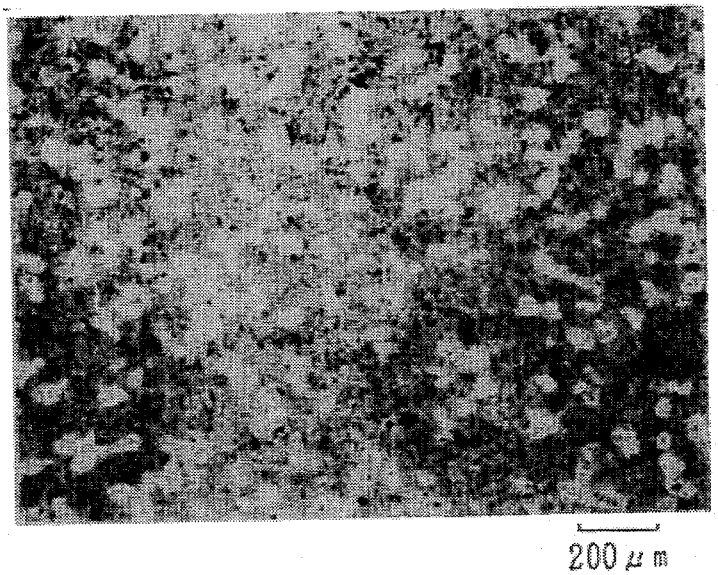
FIG. 3*b* is a photomicrograph showing a metallic structure of a diecast product.
Figure 3C:
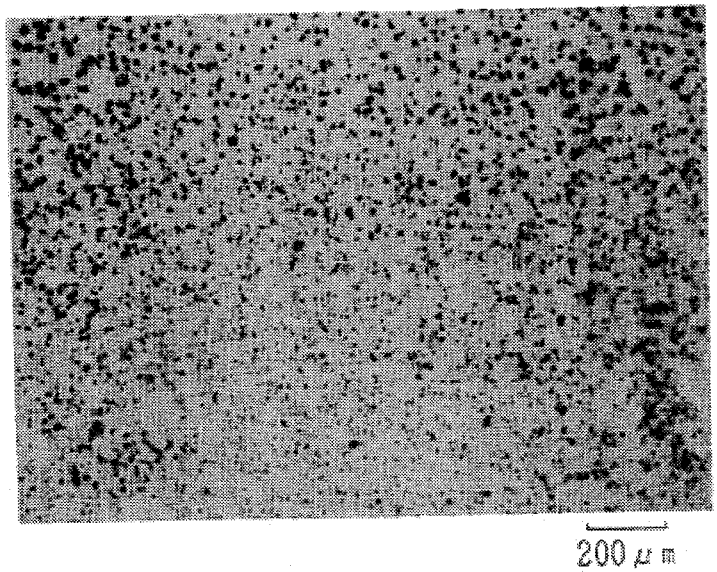
FIG. 3*c* is a photomicrograph showing a metallic structure of a diecast product after heat treatment.

The metallic structures of the ingot, diecast product and heat-treated diecast product (temperature: 900° C., holding time: 10 minutes) in the sample No. 2 are shown in FIGS. 3*a*–3*c*, respectively. In the metallic structure of FIG. 3*a*, flake graphite is equally dispersed in the ingot, while the diecast product shown in FIG. 3*b* has a metallic structure that ferrite is distributed in the form of grains and a structure between the grains is a ledeburite (eutectic structure of cementite and iron) due to the rapid cooling. In the metallic structure of FIG. 3*c* after the heat treatment for the graphitization of ledeburite, fine graphites are uniformly distributed in the product.

As mentioned above, according to the invention, the diecasting of the graphite cast iron at the solid-liquid coexisting state is carried out by restricting the opening area of the mold gate to not more than 1/10 of the pressurized area of the plunger tip, whereby diecast products of complicated shapes having a uniform microstructure without void defects can be obtained even if flake graphite cast iron and spheroidal graphite cast iron are used as a starting material. Furthermore, the service life of the mold can largely be prolonged as compared with the case of diecasting molten iron. Therefore, the invention considerably contributes to industrialize the diecasting of the graphite cast iron.

What is claimed is:

1. A process for diecasting graphite cast iron at a solid-liquid coexisting state, which comprises heating an ingot of graphite cast iron to a temperature of a solid-liquid coexisting state and then injecting the graphite cast iron with a plunger into a mold having a gate opened at an area of not more than 1/10 of a pressurized area of a tip of the plunger.

2. The process according to claim 1, wherein the graphite cast iron is selected from a graphite cast iron of flake hypo-eutectic structure and a spheroidal graphite cast iron.

3. The process according to claim 1, wherein the ingot after the heating to a given temperature of solid-liquid coexisting state is held at said temperature for not less than 3 seconds.

4. The process according to claim 2, wherein the spheroidal graphite cast iron is a structure of spheroidal graphite having a diameter of not more than 100 μm or a ledeburite structure formed by rapid solidification.

* * * * *

UNITED STATES PATENT AND TRADEMARK OFFICE

CERTIFICATE OF CORRECTION

PATENT NO. : 5,531,261

DATED : July 2, 1996

INVENTOR(S) : Chisato Yoshida, Yuichi Ando, Kunio Kitamura and Seiro Yahata

It is certified that error appears in the above-indentified patent and that said Letters Patent is hereby corrected as shown below:

In Column 2, line 27, please change "dendritie" to --dendritic--.

In Column 5, Table 2, column 3, row 6, please change "3" to --1--.

Signed and Sealed this

Twenty-fourth Day of September, 1996

*Attest:*

Bruce Lehman

BRUCE LEHMAN

*Attesting Officer*

*Commissioner of Patents and Trademarks*